US009315366B2

(12) United States Patent
Gann et al.

(10) Patent No.: US 9,315,366 B2
(45) Date of Patent: Apr. 19, 2016

(54) LIFTING APPARATUS

(71) Applicant: Shinn Fu Corporation, Taipei (TW)

(72) Inventors: Casey R. Gann, Camden Point, MO (US); Peter K. Gillespie, Raytown, MO (US)

(73) Assignee: SHINN FU CORPORATION, Taipei (TW)

( * ) Notice: Subject to any disclaimer, the term of this patent is extended or adjusted under 35 U.S.C. 154(b) by 65 days.

(21) Appl. No.: 13/904,799

(22) Filed: May 29, 2013

(65) Prior Publication Data

US 2013/0264530 A1 Oct. 10, 2013

Related U.S. Application Data

(63) Continuation of application No. 12/763,749, filed on Apr. 20, 2010, now Pat. No. 8,469,338.

(51) Int. Cl.

| | |
|---|---|
| ***B66F 5/02*** | (2006.01) |
| ***B66F 5/04*** | (2006.01) |
| ***B66F 3/22*** | (2006.01) |
| ***B66F 3/24*** | (2006.01) |
| ***B66F 3/30*** | (2006.01) |
| ***B66F 7/06*** | (2006.01) |
| ***B66F 13/00*** | (2006.01) |

(52) U.S. Cl.

CPC ... *B66F 5/02* (2013.01); *B66F 3/22* (2013.01); *B66F 3/24* (2013.01); *B66F 3/30* (2013.01); *B66F 5/04* (2013.01); *B66F 13/00* (2013.01); *B66F 7/0641* (2013.01)

(58) Field of Classification Search

CPC ..... B66F 5/02; B66F 5/04; B66F 13/00; B66F 3/22; B66F 3/24; B66F 3/30

USPC ..... 254/1, 4 B, 2 C, 2 B, 133 R, 10 B, 10 C, 254/93 R, 8 B

See application file for complete search history.

(56) References Cited

U.S. PATENT DOCUMENTS

| | | | |
|---|---|---|---|
| 2,361,544 | A | 10/1944 | Hastings, Jr. |
| D307,346 | S | 4/1990 | Kawana |
| D307,498 | S | 4/1990 | Kawana |
| 4,984,657 | A | 1/1991 | Burns |

(Continued)

OTHER PUBLICATIONS

Office Action dated Nov. 23, 2012 issued in related U.S. Appl. No. 13/250,580, 10 pages.

(Continued)

*Primary Examiner* — Lee D Wilson
*Assistant Examiner* — Seahee Yoon
(74) *Attorney, Agent, or Firm* — Lathrop & Gage LLP

(57) ABSTRACT

One disclosed lifting apparatus includes a base, a receiving portion, and a first pair of laterally offset arms. The base has proximal and distal ends, and the laterally offset arms are rotatably coupled to the base for movement between lowered and raised positions. The arms are also rotatably coupled to the receiving portion, and the receiving portion is relatively near the base distal end when the arms are at the lowered position. The arms of the first pair of arms do not share a common axis of rotation with one another. Further, a height of the first pair of arms when at the lowered position is less than the sum of: (a) a thickness of one arm of the first pair of arms; (b) a thickness of the other arm of the first pair of arms; and (c) a height of the base at the distal end.

14 Claims, 19 Drawing Sheets

(56) References Cited

U.S. PATENT DOCUMENTS

| | | | | |
|---|---|---|---|---|
| 5,271,603 | A | 12/1993 | White | |
| D344,835 | S | 3/1994 | MacEachern | |
| D346,255 | S | 4/1994 | Francis et al. | |
| D378,155 | S | 2/1997 | Bartow et al. | |
| 6,050,546 | A | 4/2000 | Peschmann et al. | |
| 6,241,227 | B1 | 6/2001 | Berdan et al. | |
| 6,561,487 | B2 | 5/2003 | Siglock | |
| 6,769,668 | B2 | 8/2004 | Siglock | |
| 6,966,542 | B2 | 11/2005 | Bettencourt | |
| 6,986,503 | B2 | 1/2006 | Arzouman | |
| 7,137,615 | B2 * | 11/2006 | Ray et al. | 254/10 B |
| 2004/0096306 | A1 | 5/2004 | Carlsson | |
| 2006/0278855 | A1 | 12/2006 | Krug | |
| 2010/0102284 | A1 | 4/2010 | Drake | |
| 2010/0207085 | A1 | 8/2010 | Thurm | |
| 2011/0101295 | A1 * | 5/2011 | Hernandez | 254/8 B |

OTHER PUBLICATIONS

Response to Office Action File in U.S. Appl. No. 13/250,580 dated May 20, 2013, 12 pages.

Statement Regarding Prior Art by Justin Poplin dated Jul. 21, 2010.

Select File History from U.S. Appl. No. 12/763,749 dated Jun. 11, 2012 through Apr. 23, 2013, 85 pages.

Notice of Allowance issued in related U.S. Appl. No. 29/447,654 dated May 23, 2013, 8 pages.

Notice of Allowance issued in related U.S. Appl. No. 29/447,651 dated May 23, 2013, 10 pages.

Operating Instructions & Parts Manual, Omega Lift Equipment Model No. 49154 (2002).

ASME PALD-2005, Part 17: Vehicle Transport Lifts (2005).

* cited by examiner

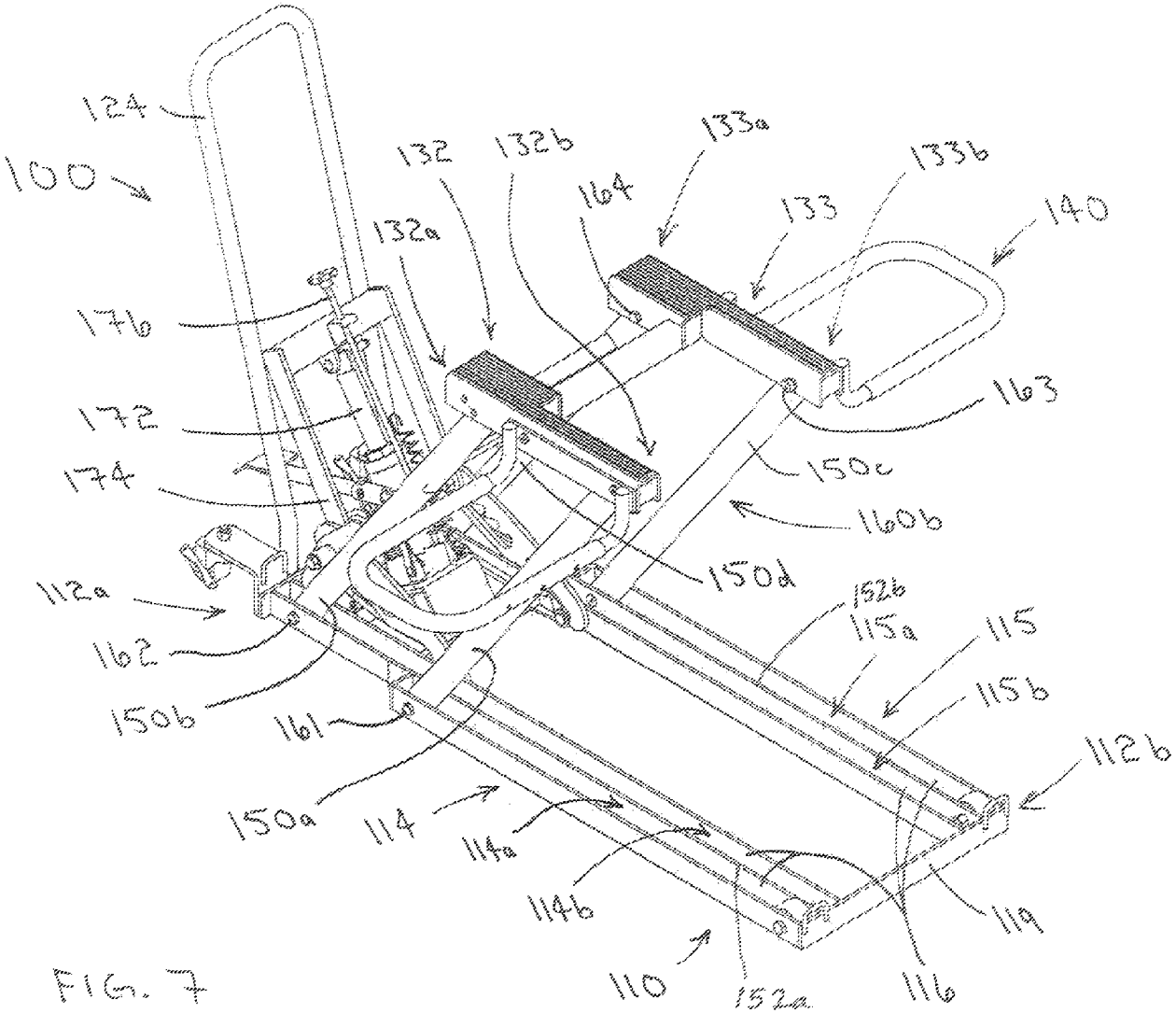
100
124
140
141
133
133a
133b
132
132a
132b
174
172
174
112a
112b
112c
112d
112e
112f
112g
112h
112i
112j
112k
112l
112m
112n
112o
112p
112q
112r
112s
112t
112u
112v
112w
112x
112y
112z
112aa
112ab
112ac
112ad
112ae
112af
112ag
112ah
112ai
112aj
112ak
112al
112am
112an
112ao
112ap
112aq
112ar
112as
112at
112au
112av
112aw
112ax
112ay
112az
112ba
112bb
112bc
112bd
112be
112bf
112bg
112bh
112bi
112bj
112bk
112bl
112bm
112bn
112bo
112bp
112bq
112br
112bs
112bt
112bu
112bv
112bw
112bx
112by
112bz
112ca
112cb
112cc
112cd
112ce
112cf
112cg
112ch
112ci
112cj
112ck
112cl
112cm
112cn
112co
112cp
112cq
112cr
112cs
112ct
112cu
112cv
112cw
112cx
112cy
112cz
112da
112db
112dc
112dd
112de
112df
112dg
112dh
112di
112dj
112dk
112dl
112dm
112dn
112do
112dp
112dq
112dr
112ds
112dt
112du
112dv
112dw
112dx
112dy
112dz
112ea
112eb
112ec
112ed
112ee
112ef
112eg
112eh
112ei
112ej
112ek
112el
112em
112en
112eo
112ep
112eq
112er
112es
112et
112eu
112ev
112ew
112ex
112ey
112ez
112fa
112fb
112fc
112fd
112fe
112ff
112fg
112fh
112fi
112fj
112fk
112fl
112fm
112fn
112fo
112fp
112fq
112fr
112fs
112ft
112fu
112fv
112fw
112fx
112fy
112fz
112ga
112gb
112gc
112gd
112ge
112gf
112gg
112gh
112gi
112gj
112gk
112gl
112gm
112gn
112go
112gp
112gq
112gr
112gs
112gt
112gu
112gv
112gw
112gx
112gy
112gz
112ha
112hb
112hc
112hd
112he
112hf
112hg
112hh
112hi
112hj
112hk
112hl
112hm
112hn
112ho
112hp
112hq
112hr
112hs
112ht
112hu
112hv
112hw
112hx
112hy
112hz
112ia
112ib
112ic
112id
112ie
112if
112ig
112ih
112ii
112ij
112ik
112il
112im
112in
112io
112ip
112iq
112ir
112is
112it
112iu
112iv
112iw
112ix
112iy
112iz
112ja
112jb
112jc
112jd
112je
112jf
112jg
112jh
112ji
112jj
112jk
112jl
112jm
112jn
112jo
112jp
112jq
112jr
112js
112jt
112ju
112jv
112jw
112jx
112jy
112jz
112ka
112kb
112kc
112kd
112ke
112kf
112kg
112kh
112ki
112kj
112kk
112kl
112km
112kn
112ko
112kp
112kq
112kr
112ks
112kt
112ku
112kv
112kw
112kx
112ky
112kz
112la
112lb
112lc
112ld
112le
112lf
112lg
112lh
112li
112lj
112lk
112ll
112lm
112ln
112lo
112lp
112lq
112lr
112ls
112lt
112lu
112lv
112lw
112lx
112ly
112lz
112ma
112mb
112mc
112md
112me
112mf
112mg
112mh
112mi
112mj
112mk
112ml
112mm
112mn
112mo
112mp
112mq
112mr
112ms
112mt
112mu
112mv
112mw
112mx
112my
112mz
112na
112nb
112nc
112nd
112ne
112nf
112ng
112nh
112ni
112nj
112nk
112nl
112nm
112nn
112no
112np
112nq
112nr
112ns
112nt
112nu
112nv
112nw
112nx
112ny
112nz
112oa
112ob
112oc
112od
112oe
112of
112og
112oh
112oi
112oj
112ok
112ol
112om
112on
112oo
112op
112oq
112or
112os
112ot
112ou
112ov
112ow
112ox
112oy
112oz
112pa
112pb
112pc
112pd
112pe
112pf
112pg
112ph
112pi
112pj
112pk
112pl
112pm
112pn
112po
112pp
112pq
112pr
112ps
112pt
112pu
112pv
112pw
112px
112py
112pz
112qa
112qb
112qc
112qd
112qe
112qf
112qg
112qh
112qi
112qj
112qk
112ql
112qm
112qn
112qo
112qp
112qq
112qr
112qs
112qt
112qu
112qv
112qw
112qx
112qy
112qz
112ra
112rb
112rc
112rd
112re
112rf
112rg
112rh
112ri
112rj
112rk
112rl
112rm
112rn
112ro
112rp
112rq
112rr
112rs
112rt
112ru
112rv
112rw
112rx
112ry
112rz
112sa
112sb
112sc
112sd
112se
112sf
112sg
112sh
112si
112sj
112sk
112sl
112sm
112sn
112so
112sp
112sq
112sr
112ss
112st
112su
112sv
112sw
112sx
112sy
112sz
112ta
112tb
112tc
112td
112te
112tf
112tg
112th
112ti
112tj
112tk
112tl
112tm
112tn
112to
112tp
112tq
112tr
112ts
112tt
112tu
112tv
112tw
112tx
112ty
112tz
112ua
112ub
112uc
112ud
112ue
112uf
112ug
112uh
112ui
112uj
112uk
112ul
112um
112un
112uo
112up
112uq
112ur
112us
112ut
112uv
112uw
112ux
112uy
112uz
112va
112vb
112vc
112vd
112ve
112vf
112vg
112vh
112vi
112vj
112vk
112vl
112vm
112vn
112vo
112vp
112vq
112vr
112vs
112vt
112vu
112vv
112vw
112vx
112vy
112vz
112wa
112wb
112wc
112wd
112we
112wf
112wg
112wh
112wi
112wj
112wk
112wl
112wm
112wn
112wo
112wp
112wq
112wr
112ws
112wt
112wu
112wv
112ww
112wx
112wy
112wz
112xa
112xb
112xc
112xd
112xe
112xf
112xg
112xh
112xi
112xj
112xk
112xl
112xm
112xn
112xo
112xp
112xq
112xr
112xs
112xt
112xu
112xv
112xw
112xx
112xy
112xz
112ya
112yb
112yc
112yd
112ye
112yf
112yg
112yh
112yi
112yj
112yk
112yl
112ym
112yn
112yo
112yp
112yq
112yr
112ys
112yt
112yu
112yv
112yw
112yx
112yy
112yz
112za
112zb
112zc
112zd
112ze
112zf
112zg
112zh
112zi
112zj
112zk
112zl
112zm
112zn
112zo
112zp
112zq
112zr
112zs
112zt
112zu
112zv
112zw
112zx
112zy
112zz

LIFTING APPARATUS

RELATED APPLICATIONS

This application is a continuation of U.S. patent application Ser. No. 12/763,749, filed Apr. 20, 2010.

BACKGROUND

The disclosed subject matter is directed to lifting apparatus, and in particular to apparatus capable of lifting low-clearance devices and selectively maintaining those devices at a lifted position.

SUMMARY

In one embodiment, a lifting apparatus includes a base, a receiving portion, and a first pair of laterally offset arms. The base has a proximal end and a distal end, and the laterally offset arms are rotatably coupled to the base for movement between lowered and raised positions. The arms are also rotatably coupled to the receiving portion, and the receiving portion is relatively near the base distal end when the arms are at the lowered position. The arms of the first pair of arms do not share a common axis of rotation with one another. Further, a height of the first pair of arms when at the lowered position is less than the sum of: (a) a thickness of one arm of the first pair of arms; (b) a thickness of the other arm of the first pair of arms; and (c) a height of the base at the distal end.

In another embodiment, a lifting apparatus includes a base, a first pair of rotatable arms, a second pair of rotatable arms, and a receiving portion. The base has a proximal end, a distal end, a first pair of generally parallel laterally offset channels with open top ends, and a second pair of generally parallel laterally offset channels with open top ends. The first pair of rotatable arms extends inside the first pair of channels. The second pair of rotatable arms extends inside the second pair of channels. One arm of the first pair of arms and one arm of the second pair of arms rotate about a generally common first axis, and the other arm of the first pair of arms and the other arm of the second pair of arms rotate about a generally common second axis. The first and second pairs of arms are rotatable in concert between lowered and raised positions. The arms of the first pair of arms are generally laterally adjacent one another when at the lowered position, and the arms of the second pair of arms are generally laterally adjacent one another when at the lowered position. One arm of the first pair of arms and one arm of the second pair of arms is rotatably coupled to the receiving portion about a generally common third axis, and the other arm of the first pair of arms and the other arm of the second pair of arms is rotatably coupled to the receiving portion about a generally common fourth axis. The first and second axes are separated by a distance generally equal to a distance between the third and fourth axes.

BRIEF DESCRIPTION OF THE DRAWINGS

FIG. 7 is a perspective view of the lifting apparatus of FIG. 1, at a raised configuration.

FIG. 12 is a perspective view of a portion of the lifting apparatus of FIG. 1.

DETAILED DESCRIPTION

Figure 1:
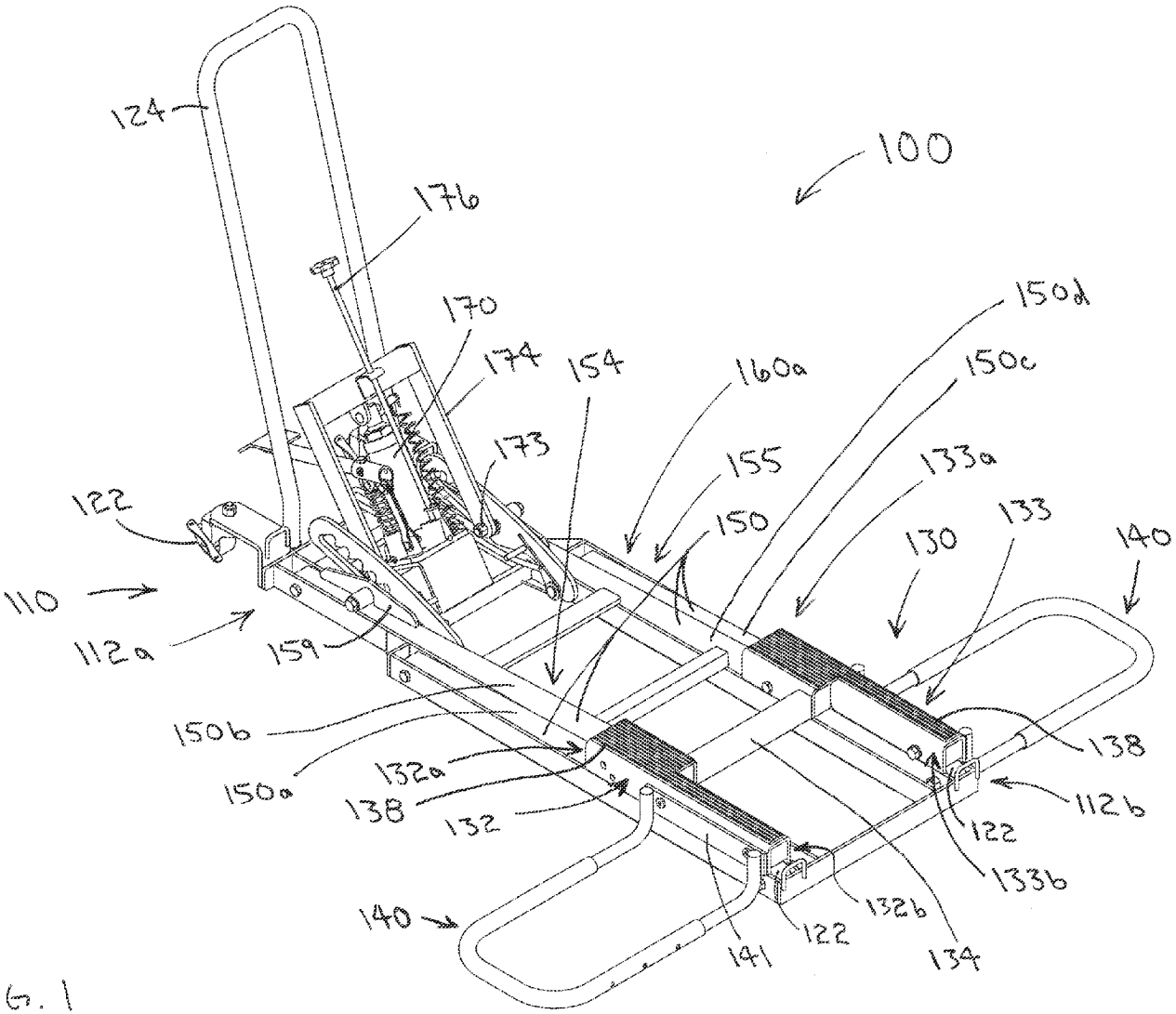
FIG. 1 is a perspective view of a lifting apparatus, at a lowered configuration.
Figure 2:
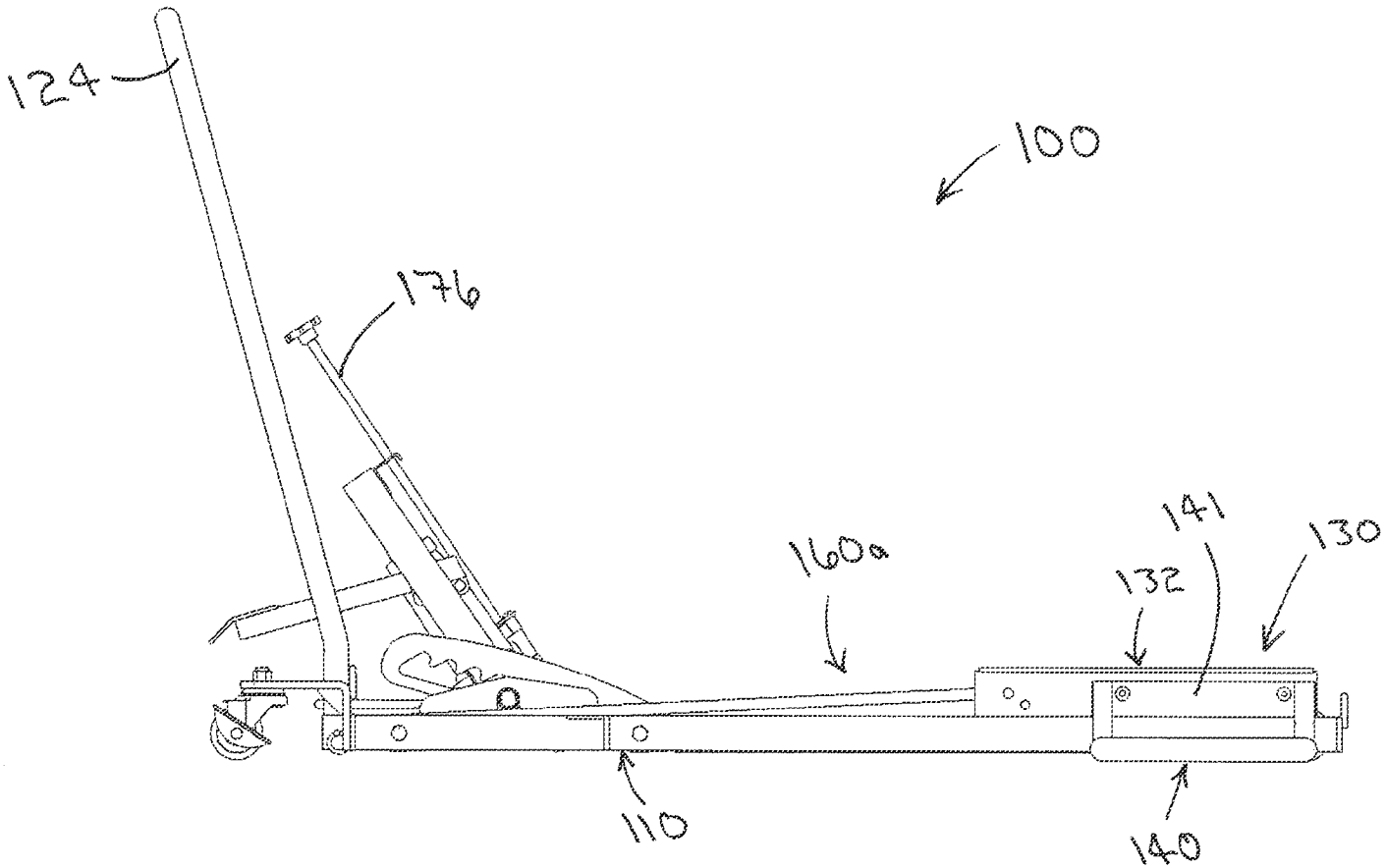
FIG. 2 is a side view of the lifting apparatus of FIG. 1, at the lowered configuration.
Figure 3:
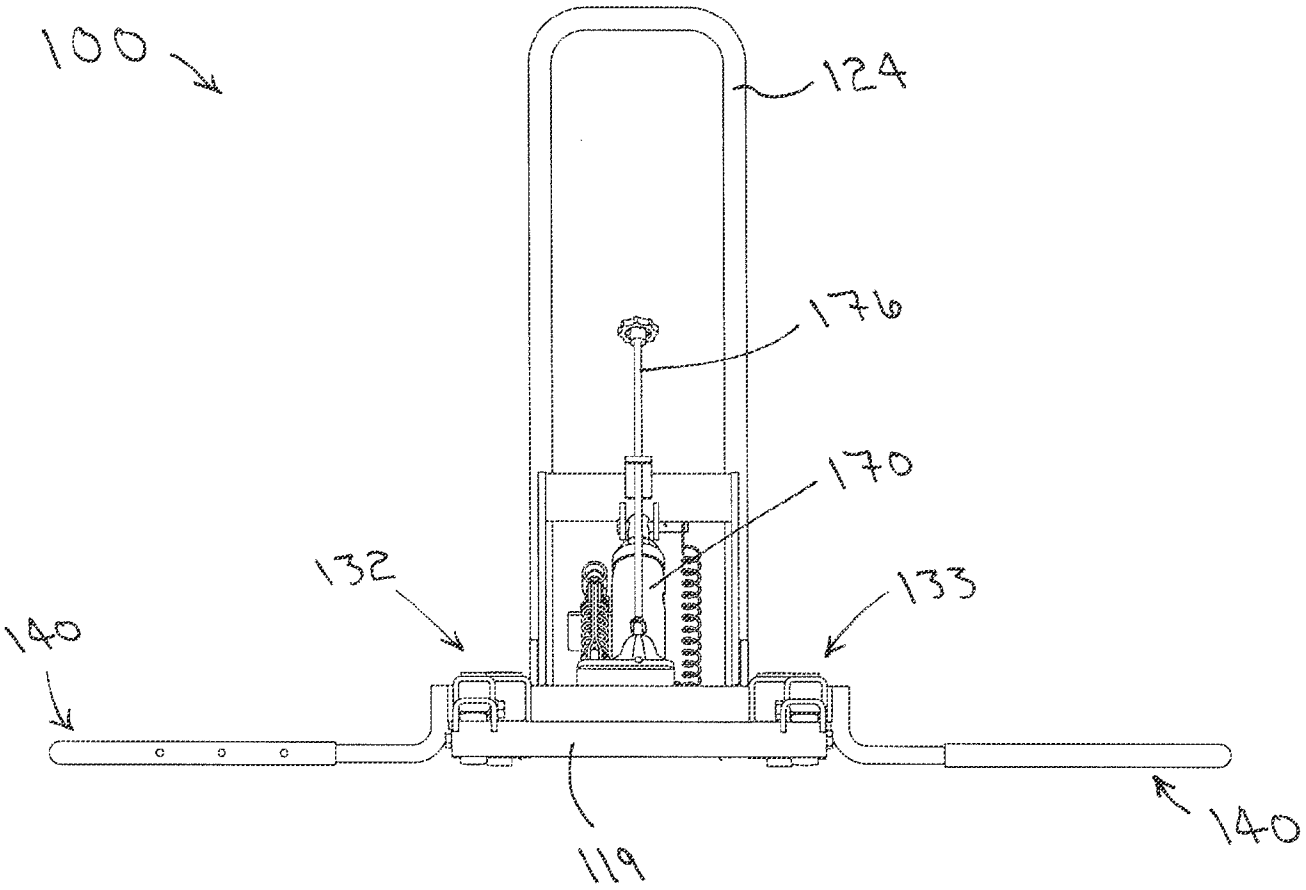
FIG. 3 is a front view of the lifting apparatus of FIG. 1, at the lowered configuration.

FIGS. 1 through 14 show a lifting apparatus 100 according to one embodiment. The lifting apparatus 100 has a base 110, a receiving portion 130, and a plurality of arms 150.

The base 110 is best shown in FIG. 7 and has proximal and distal ends 112*a*, 112*b*. As shown, the base 110 may have a first pair 114 of generally parallel laterally offset channels 114*a*, 114*b* and a second pair 115 of generally parallel laterally offset channels 115*a*, 115*b*. The channels 114*a*, 114*b*, 115*a*, 115*b* have open top ends 116 and may be sufficiently long and open to allow the arms 150 to be seated, as discussed further below. Wall 152*a* is shown partially defining both channel 114*a* and 114*b* and separating those channels from one another. Wall 152*b* is shown partially defining both channel 115*a* and 115*b* and separating those channels from one another. Strap 119 may fix the position of the first and second pairs of channels 114, 115 relative to one another at the distal end 112*b* and aid in transferring forces throughout the base 110, and the position of the first and second pairs of channels 114, 115 relative to one another at the proximal end 112*a* may also be fixed. Respective plates 117 (FIG. 6) may be located below the channels 114, 115 to prevent the base 110 from sinking in unstable (e.g., muddy) environments, and may also stabilize the base 110. The plates 117 may be, for example, 1.5 mm thick steel plate.

To aid in mobility, the base 110 may include wheels 122 and handle 124 (FIG. 1). But to prevent unintended movement, it may be desirable for at least two of the wheels 122

(e.g., the wheels 122 at the proximate end 112*a*) to be lockable. The base 110 may be constructed of steel, aluminum, and/or any other appropriate material, and may be formed through welding, riveting, and/or any other appropriate processes, as those skilled in the art will appreciate. The height 125 of the base 110 at the distal end 112*b* is specifically shown in FIG. 8, and is referenced further below.

Turning to the receiving portion 130, as shown for example in FIG. 1, it includes first and second platforms 132, 133 laterally spaced from one another. The first platform 132 has proximal and distal ends 132*a*, 132*b*, and the second platform 133 has proximal and distal ends 133*a*, 133*b*. A strap 134 may fix the position of the first and second platforms 132, 133 relative to one another, and the platforms 132, 133 may relate to the base 110 such that the platform distal ends 132*b*, 133*b* are closer to the base distal end 112*b* than the platform proximal ends 132*a*, 133*a* are to the base distal end 112*b*.

Figure 5A:
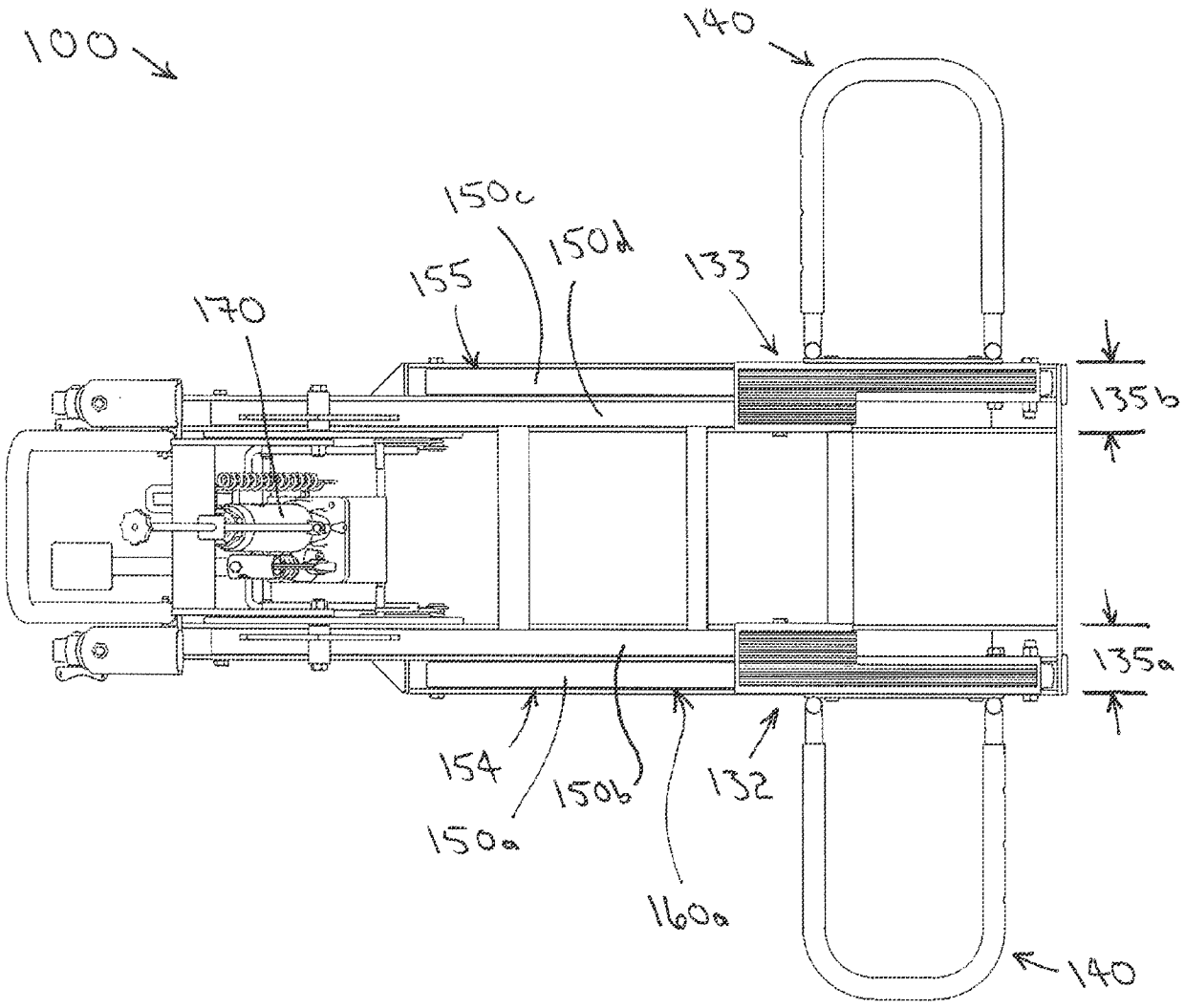
FIG. 5*a* is a top view of the lifting apparatus of FIG. 1, at the lowered configuration, and with tire-receiving members at a retracted configuration.

Though the platforms 132, 133 may be, for example, rectangular, it may be desirable for the platforms 132, 133 to instead be L-shaped (as shown) or otherwise configured such that a distance between the platform distal ends 132*b*, 133*b* is greater than a distance between the platform proximal ends 132*a*, 133*a*. In other words, it may be desirable for the opening between the platform distal ends 132*b*, 133*b* to be greater than the opening between the platform proximal ends 132*a*, 133*a*. As shown in FIG. 5*a*, the maximum width 135*a* of the platform 132 may generally correspond to the width of the first pair of arms 154 (discussed below), and the maximum width 135*b* of the platform 133 may generally correspond to the width of the second pair of arms 155 (discussed below).

As those skilled in the art will appreciate, the platforms 132, 133 may be constructed of steel, aluminum, and/or any other appropriate material, and may be formed through any appropriate processes. It may be desirable to have a non-slip material 138 at upper ends of the platforms 132, 133, as shown in FIG. 1

Figure 4:
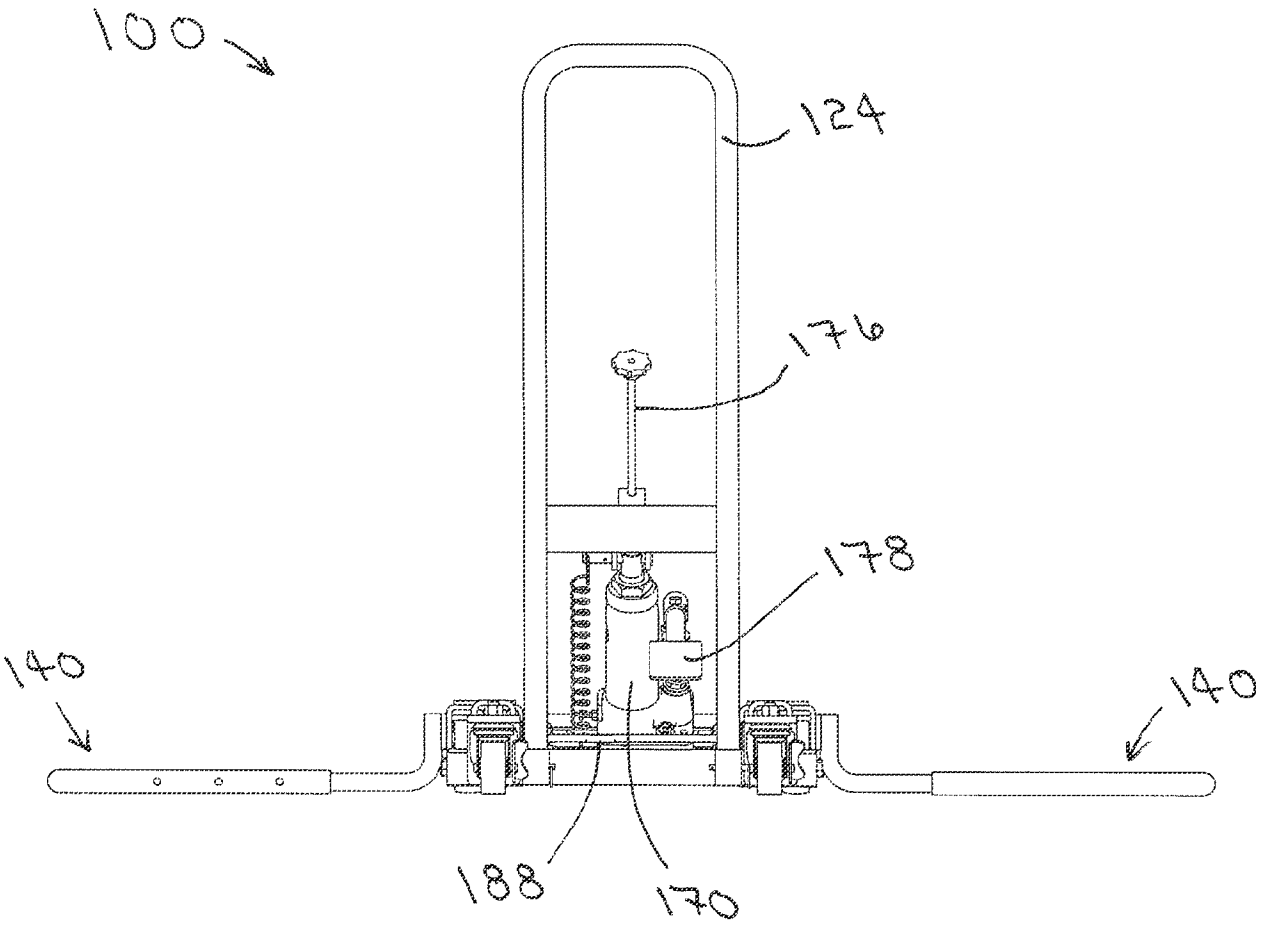
FIG. 4 is a rear view of the lifting apparatus of FIG. 1, at the lowered configuration.
Figure 5B:
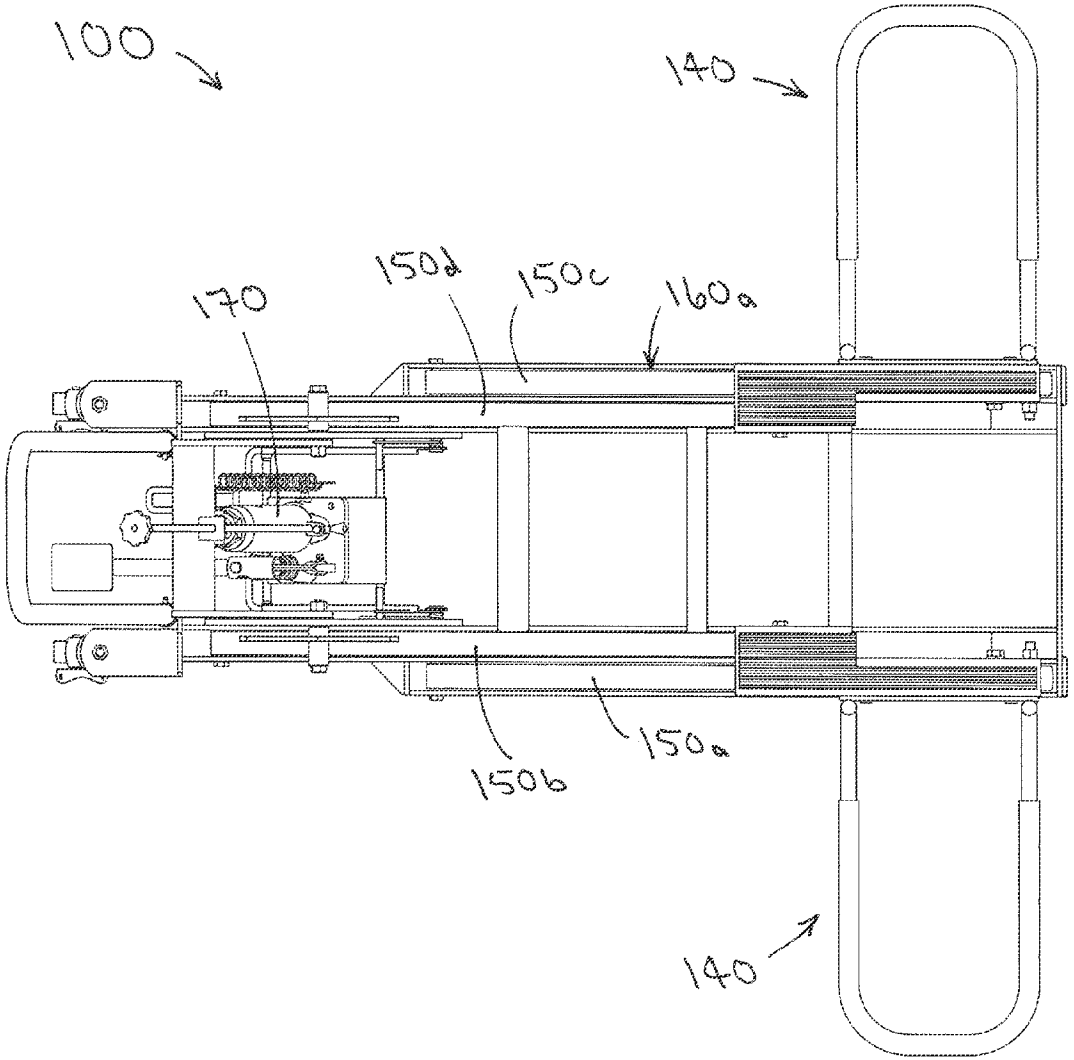
FIG. 5*b* is a top view of the lifting apparatus of FIG. 1, at the lowered configuration, and with tire-receiving members at a centrally-extended configuration.
Figure 5C:
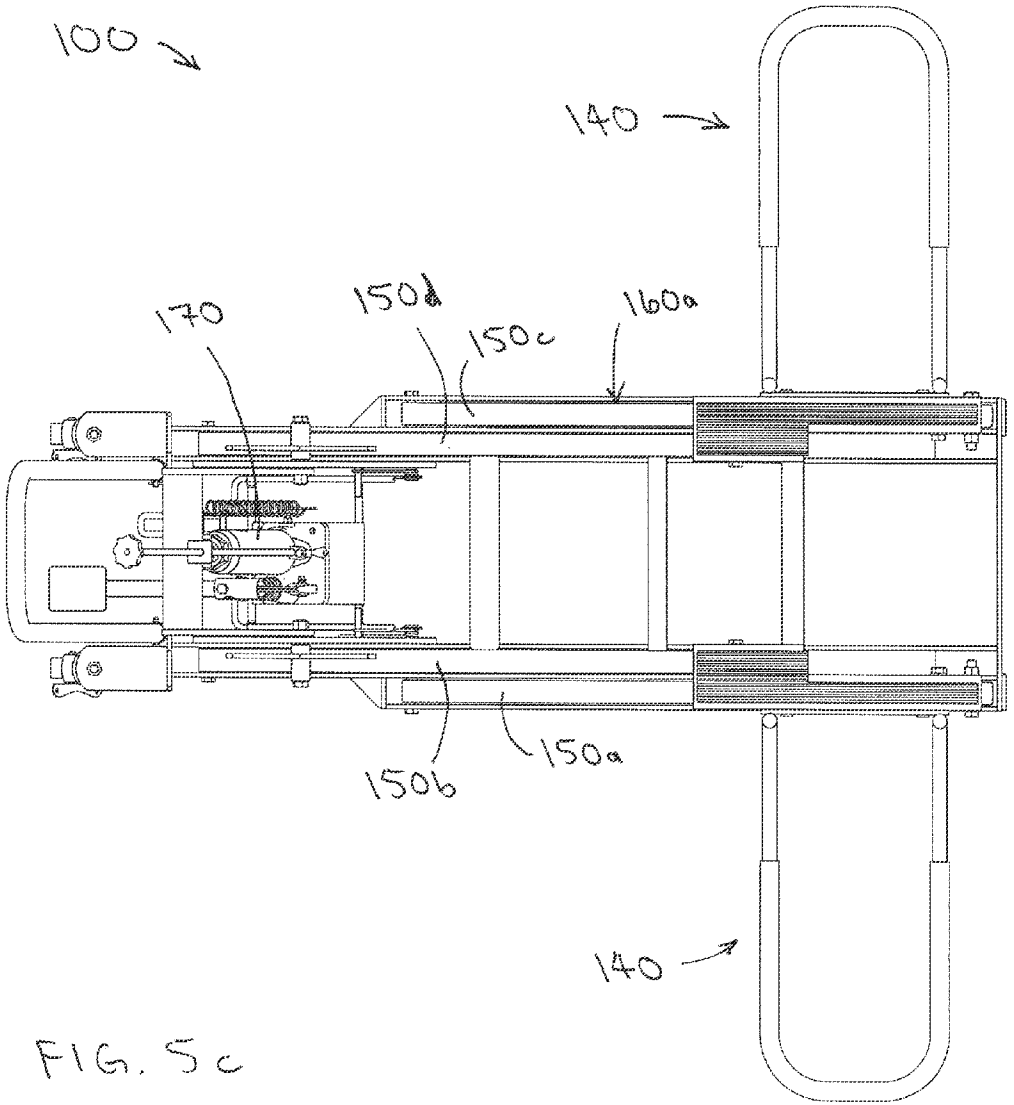
FIG. 5*c* is a top view of the lifting apparatus of FIG. 1, at the lowered configuration, and with tire-receiving members at an extended configuration.
Figure 6:
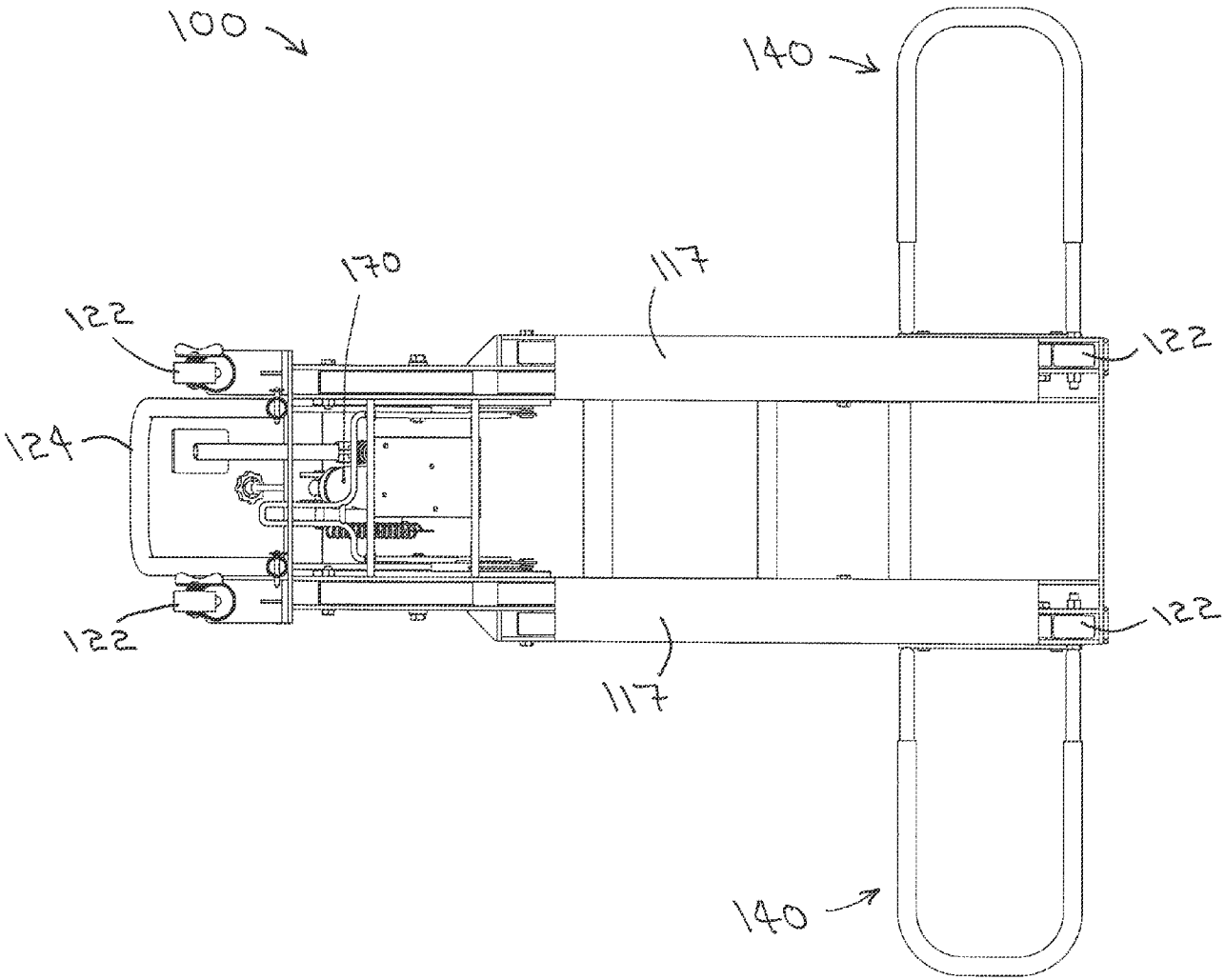
FIG. 6 is a bottom view of the lifting apparatus of FIG. 1, at the lowered configuration.
Figure 8:
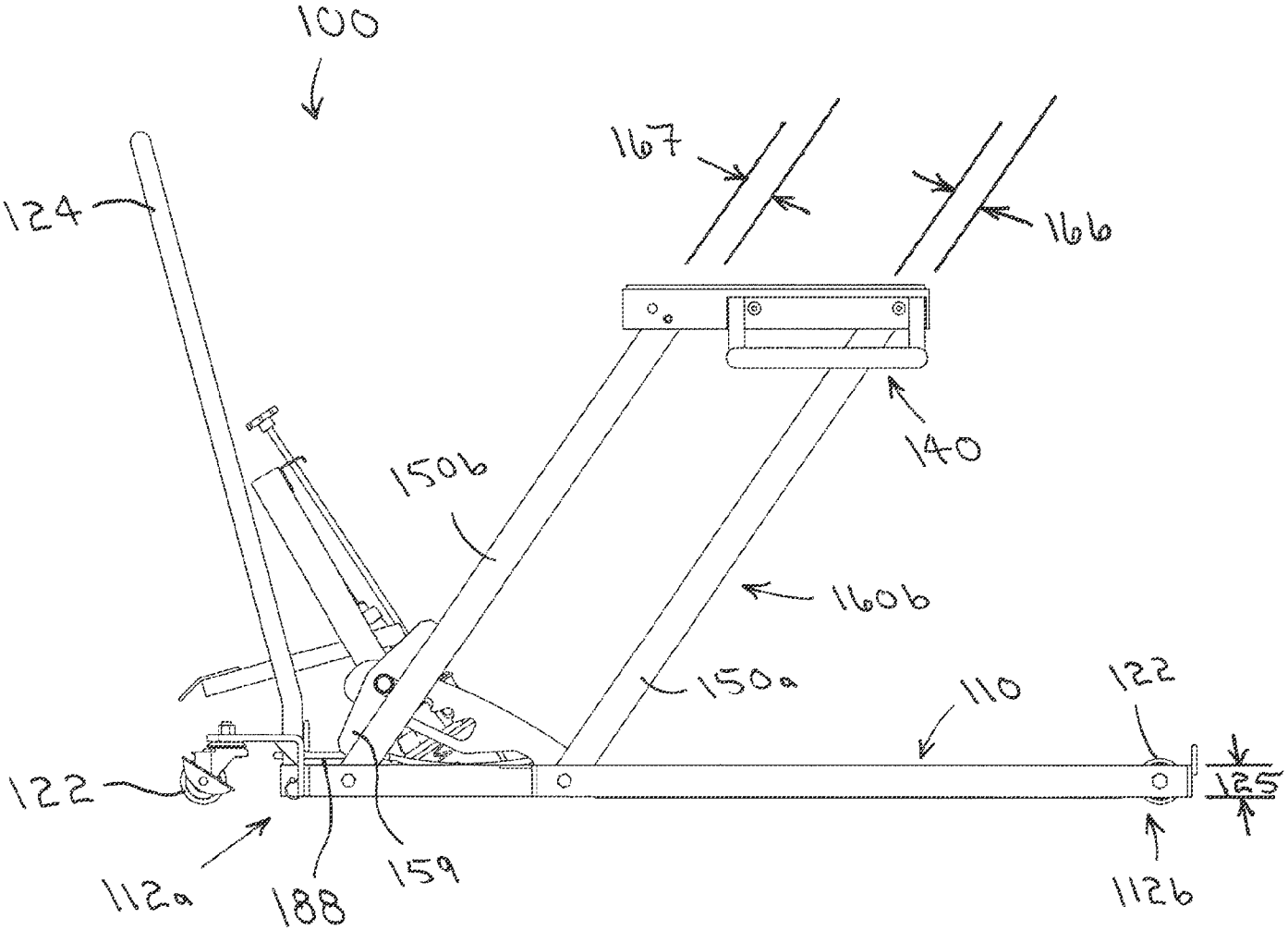
FIG. 8 is a side view of the lifting apparatus of FIG. 1, at the raised configuration.
Figure 9:
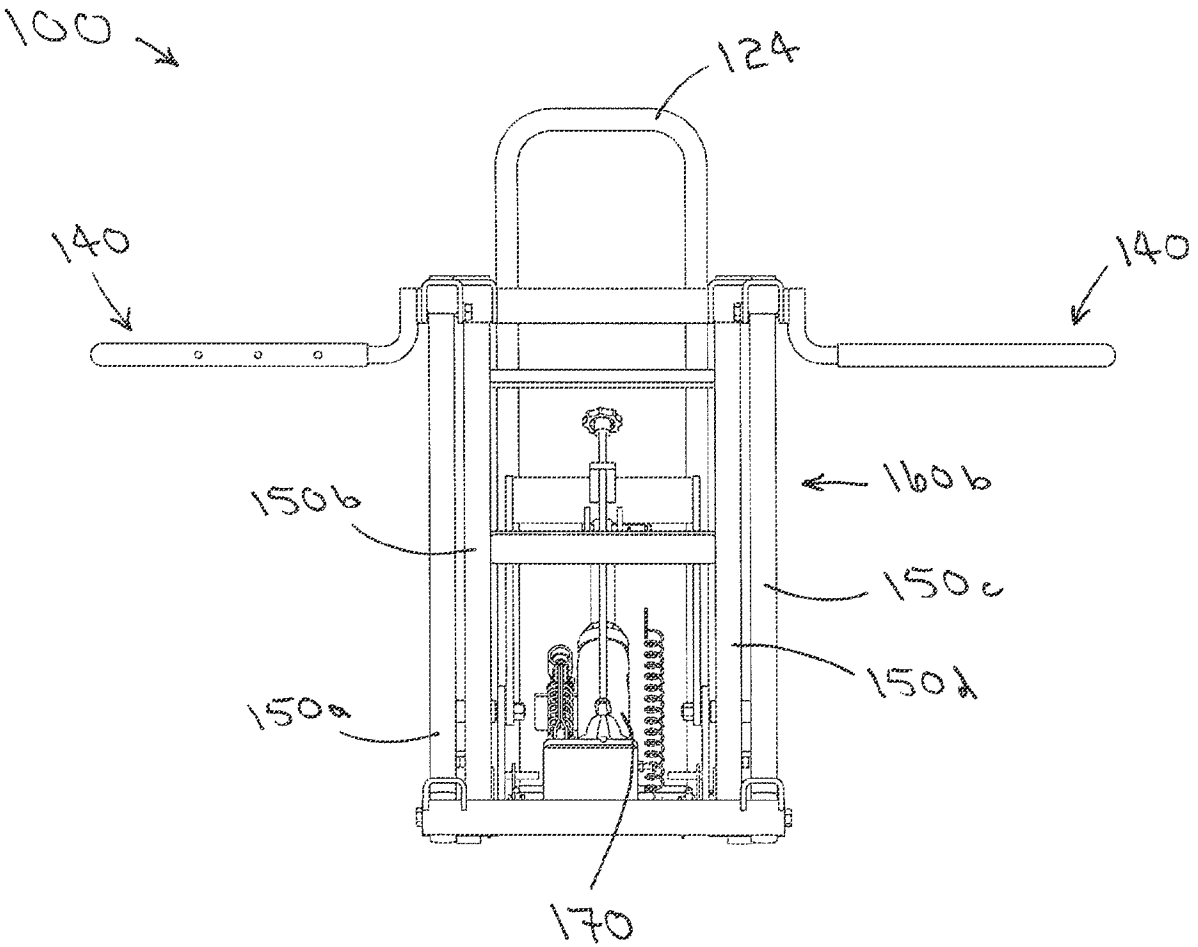
FIG. 9*a* is a front view of the lifting apparatus of FIG. 1, at the raised configuration.
FIG. 9*b* is a rear view of the lifting apparatus of FIG. 1, at the raised configuration.
Figure 9B:
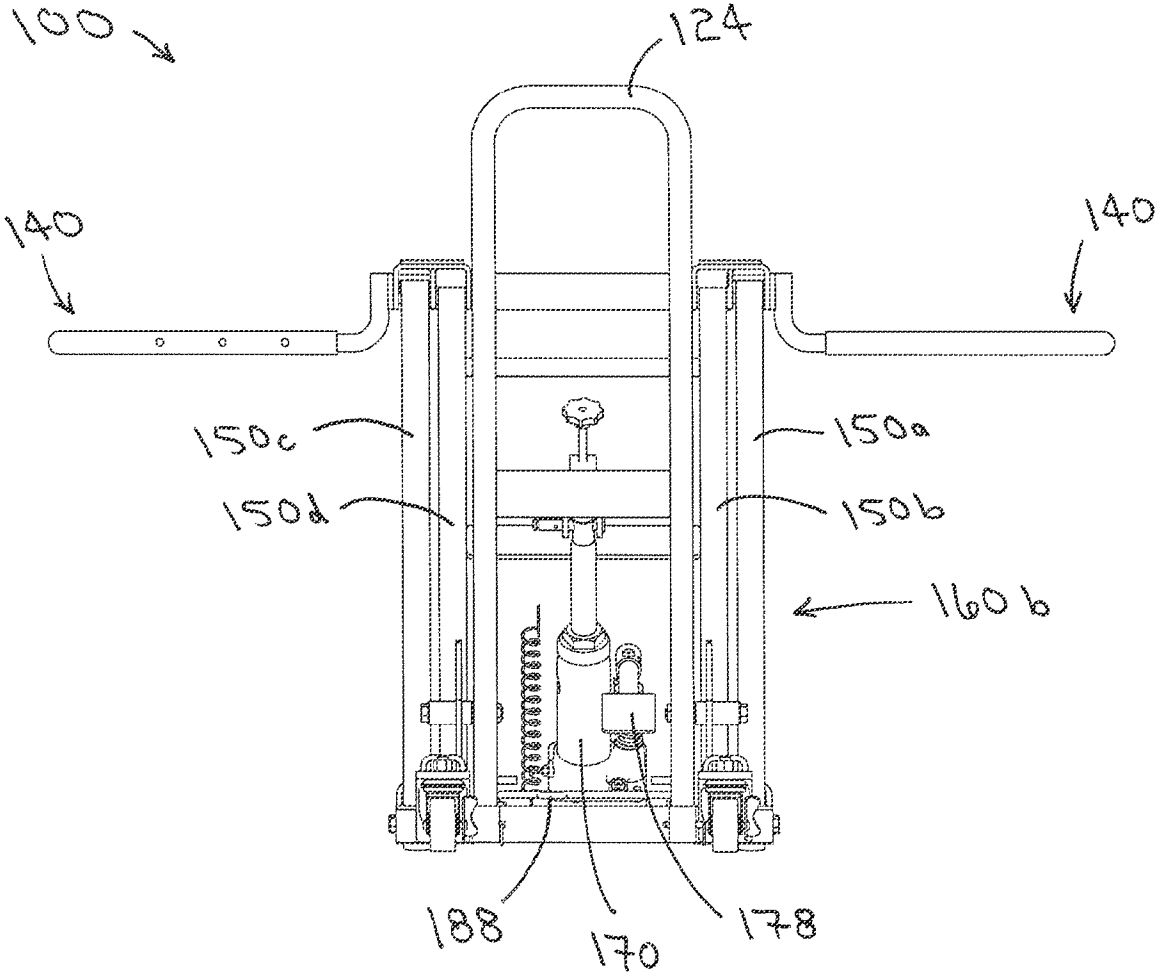
Figure 10:
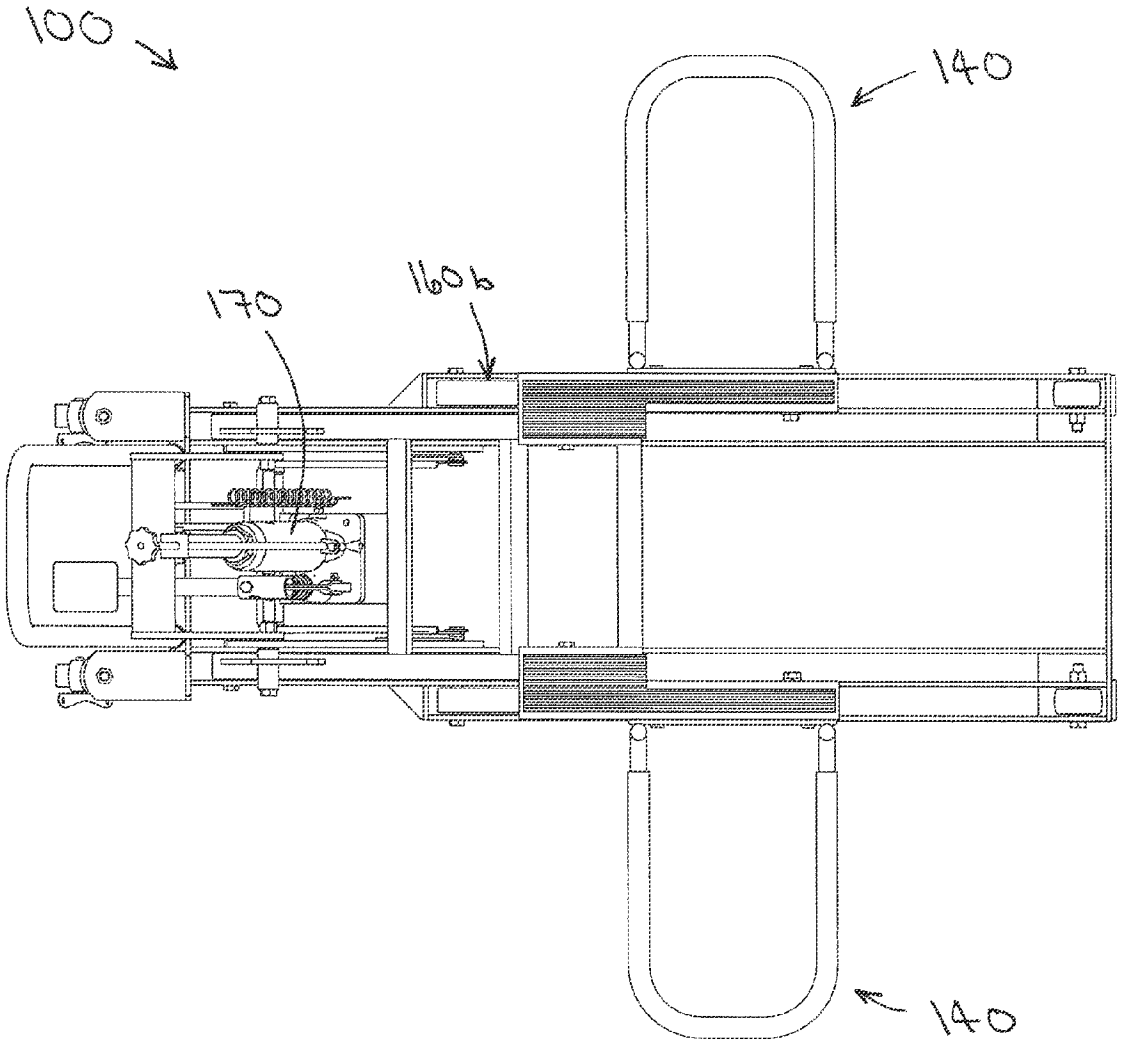
FIG. 10*a* is a top view of the lifting apparatus of FIG. 1, at the raised configuration.
FIG. 10*b* is a bottom view of the lifting apparatus of FIG. 1, at the raised configuration.
Figure 10B:
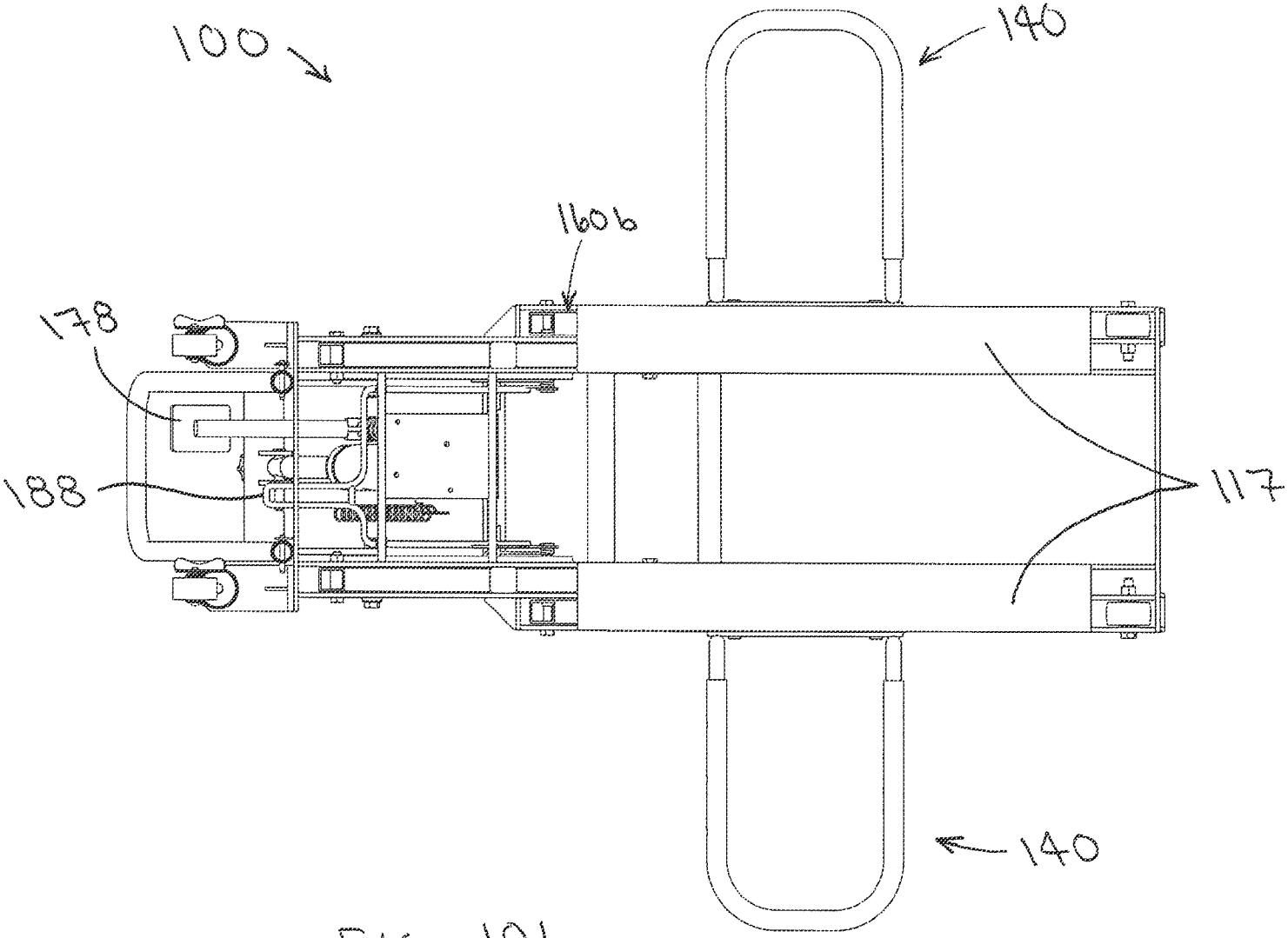
Figure 11A:
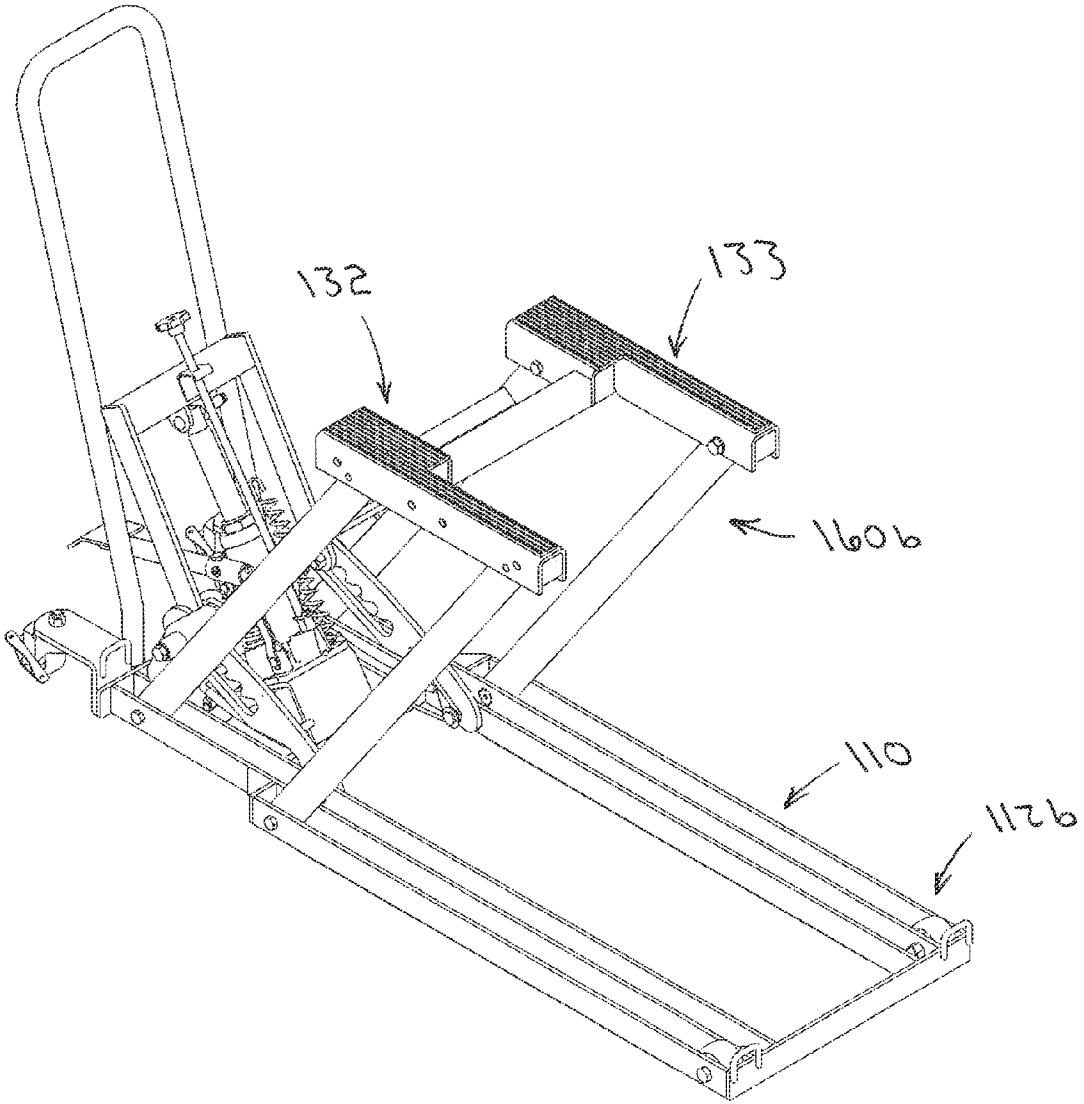
FIG. 11*a* is a perspective view of the lifting apparatus of FIG. 1, at the raised configuration, and with tire-receiving members removed.
Figure 11B:
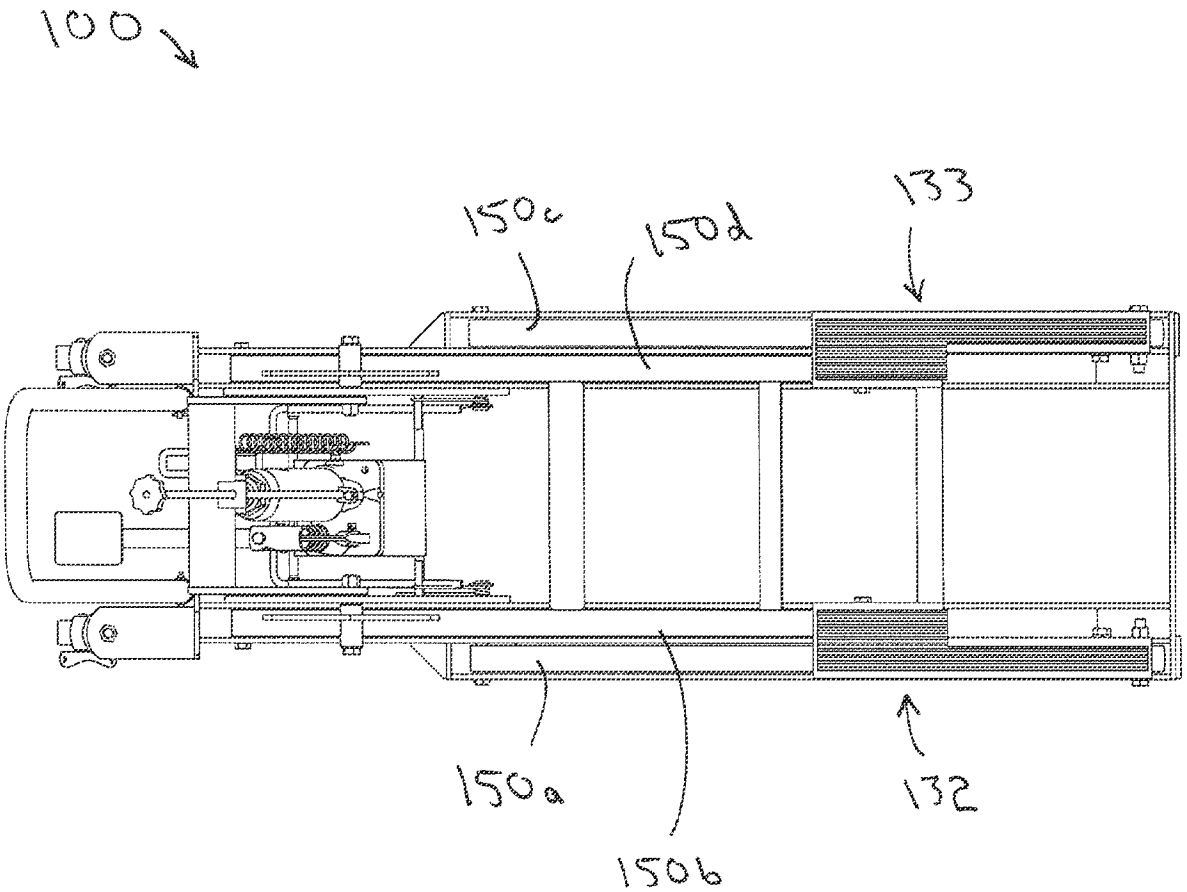
FIG. 11*b* is a top view of the lifting apparatus of FIG. 1, at the lowered configuration, and with tire-receiving members removed.
Figure 17:
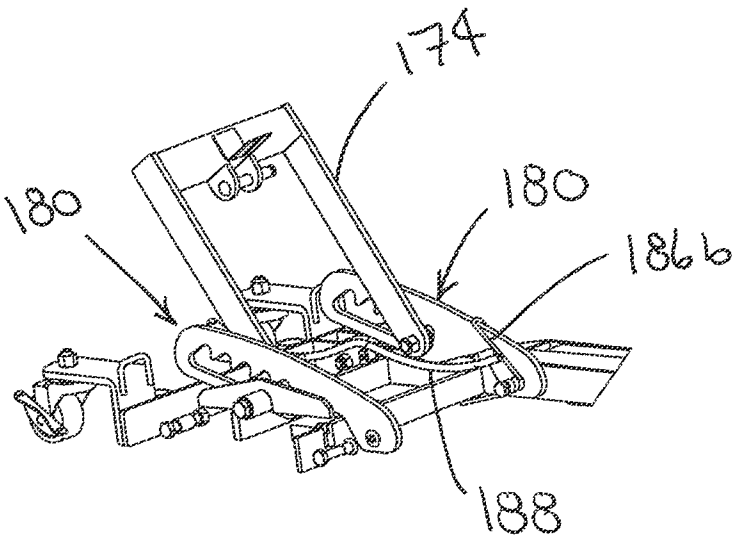

The receiving portion 130 may also include a tire-receiving member 140 operatively coupled to each platform 132, 133, and attachment between the tire-receiving members 140 and the platforms 132, 133 may be permanent or reversible (e.g., through quick-locking mechanisms, removable bolts, etc.). FIGS. 1 through 10*b* show the tire-receiving members 140 coupled to the platforms 132, 133, and FIGS. 11*a* and 11*b* show the platforms 132, 133 with the tire-receiving member 140 removed. Though not specifically shown in the drawings, plates 141 may have channels that allow the tire-receiving members 140 to be adjusted along the length of the platforms 132, 133, or the plates 141 may be received at different locations along the platforms 132, 133 to allow for adjustment. The tire-receiving members 140 extend outwardly from the respective platforms 132, 133, and (as shown for example in FIGS. 1 through 3) it may be preferable for the tire-receiving members 140 to extend outwardly below the respective platforms 132, 133. The tire-receiving members 140 may be U-shaped (as shown) or otherwise provide a configuration for securely receiving tires, and the tire-receiving members 140 may be telescopic to receive tires from devices having different spacings between the tires. For example, FIG. 5*a* shows the telescopic tire-receiving members 140 at a retracted configuration, FIG. 5*b* shows the telescopic tire-receiving members 140 at a centrally-extended configuration, and FIG. 5*c* shows the telescopic tire-receiving members 140 at an extended configuration. It may be desirable for at least a portion of the tire-receiving members 140 to be rubberized to increase friction between the tire-receiving members 140 and tires being situated thereon.

Attention now being directed to the arms 150, the arms 150 (specifically denoted in the drawings by reference numbers 150*a*, 150*b*) in the first pair 154 are laterally offset from one another and respectively extend inside the first pair 114 of channels 114*a*, 114*b*, and the arms 150 (specifically denoted in the drawings by reference numbers 150*c*, 150*d*) in the second pair 155 are laterally offset from one another and respectively extend inside the second pair 115 of channels 115*a*, 115*b*. All of the arms 150 are rotatably coupled to the base 110 for movement (i.e., rotation) in concert between a lowered position 160*a* (FIGS. 1 through 6 and 11*b*) and a raised position 160*b* (FIGS. 7 through 11*a*). While other configurations are clearly possible, it may be desirable for one arm 150 of each pair 154, 155 (e.g., arm 150*a* and arm 150*c*) to rotate relative to the base 110 about a generally common axis (e.g., an axis extending in line with pin 161, shown in FIG. 7), and for the other arm 150 of each pair 154, 155 (e.g., arm 150*b* and arm 150*d*) to rotate relative to the base 110 about another generally common axis (e.g., an axis extending in line with pin 162, shown in FIG. 7). An imaginary plane passing through these two imaginary axes may be generally horizontal, such that the axes are at approximately the same relative height. Further, the arms 150*a*, 150*b* in the first pair 154 do not share a generally common axis of rotation with one another, and the arms 150*c*, 150*d* in the second pair 155 do not share a generally common axis of rotation with one another. As shown in FIG. 1, the arms 150*a*, 150*b* in the first pair 154 are generally laterally adjacent one another when at the lowered position 160*a*, and the arms 150*c*, 150*d* in the second pair 155 are generally laterally adjacent one another when at the lowered position 160*a*.

All of the arms 150 are also rotatably coupled to the receiving portion 130, causing the receiving portion 130 to move between a lowered position when the arms 150 are at the lowered position 160*a* and a raised position when the arms 150 are at the raised position 160*b*. The receiving portion 130 is relatively near the base distal end 112*b* when the arms 150 are at the lowered position 160*a*, and it may be desirable for one arm 150 of each pair 154, 155 (e.g., arm 150*a* and arm 150*c*) to rotate relative to the receiving portion 130 about a generally common axis (e.g., an axis extending in line with pin 163 at the platform distal ends 132*b*, 133*b*, shown in FIG. 7), and for the other arm 150 of each pair 154, 155 (e.g., arm 150*b* and arm 150*d*) to rotate relative to the receiving portion 130 about another generally common axis (e.g., an axis extending in line with pin 164 at the platform proximal ends 132*a*, 133*a*, shown in FIG. 7). An imaginary plane passing through these two imaginary axes may remain generally horizontal, such that the receiving portion 130 stays relatively horizontal, regardless of whether the arms 150 are at the lowered or raised positions 160*a*, 160*b*. Those skilled in the art will realize that horizontal positioning is not required, so long as the arms 150, the base 110, and the receiving portion 130 form a parallelogram. To allow rotation of the arms 150, the distance between the pin 161 and the pin 162 (and thus the axes associated with those pins) may be generally equal to the distance between the pin 163 and the pin 164 (and thus the axes associated with those pins). As shown in FIG. 7, both arms 150*a*, 150*b* of the first pair of arms 154 may be coupled to the first platform 132, and both arms 150*c*, 150*d* of the second pair of arms 155 may be coupled to the second platform 133.

It may be very desirable for a height of the first pair 154 of arms 150*a*, 150*b* when at the lowered position 160*a* (FIGS. 1 through 6 and 11*b*) to be less than the sum of: a thickness 166 (FIG. 8) of the arm 150*a*, a thickness 167 (FIG. 8) of the arm 150*b*, and the height 125 (FIG. 8) of the base 110 at the distal end 112*b*. The second pair 155 of arms 150*c*, 150*d* may have similar dimensions to the first pair 154 such that the arms 150*c*, 150*d* (and thus also the receiving portion 130) are very low when at the lowered position 160*a*, allowing the lifting apparatus 100 to be used to raise low-clearance devices.

Figure 15:
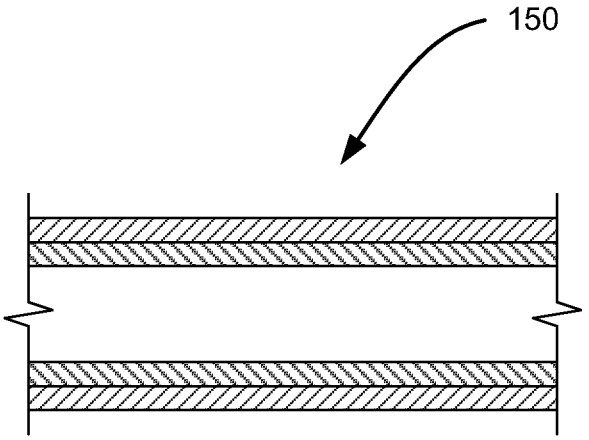
FIG. 15 is a sectional view showing a telescopic arm of the lifting apparatus according to one embodiment.

As those skilled in the art will appreciate, the arms 150 may be constructed of steel, aluminum, and/or any other appropriate material, and may be formed through any appropriate processes. And, as shown in FIG. 15, the arms 150 may be telescopic.

Various means for moving the pairs 154, 155 of arms 150 between the lowered and raised positions 160*a*, 160*b* may be included. For example, a winch may be used to wind and unwind a rope or chain coupled to one of the arms 150. Or, for example, a motor and gearing may be used to rotate one of the arms 150. Or, as shown throughout the drawings, a pump 170 (e.g., a hydraulic or pneumatic pump) may be in communication with at least one of the arms 150 to selectively move the arms 150 between the lowered and raised positions 160*a*, 160*b*. In the embodiment shown in the drawings, the pump 170 moves a piston 172 (FIG. 7), which is operatively coupled to two of the arms 150 (and particularly to a flange 159 on each arm 150*b*, 150*d*) by pins 173 and structure 174. The pump 170 includes a controlled release valve 176 (FIG. 1), allowing the arms 150 to move from the raised position 160*b* to the lowered position 160*a* at various controlled speeds. As shown in FIG. 4, a foot pedal 178 may be used to actuate the pump 170, though other inputs are of course possible.

Figure 13:
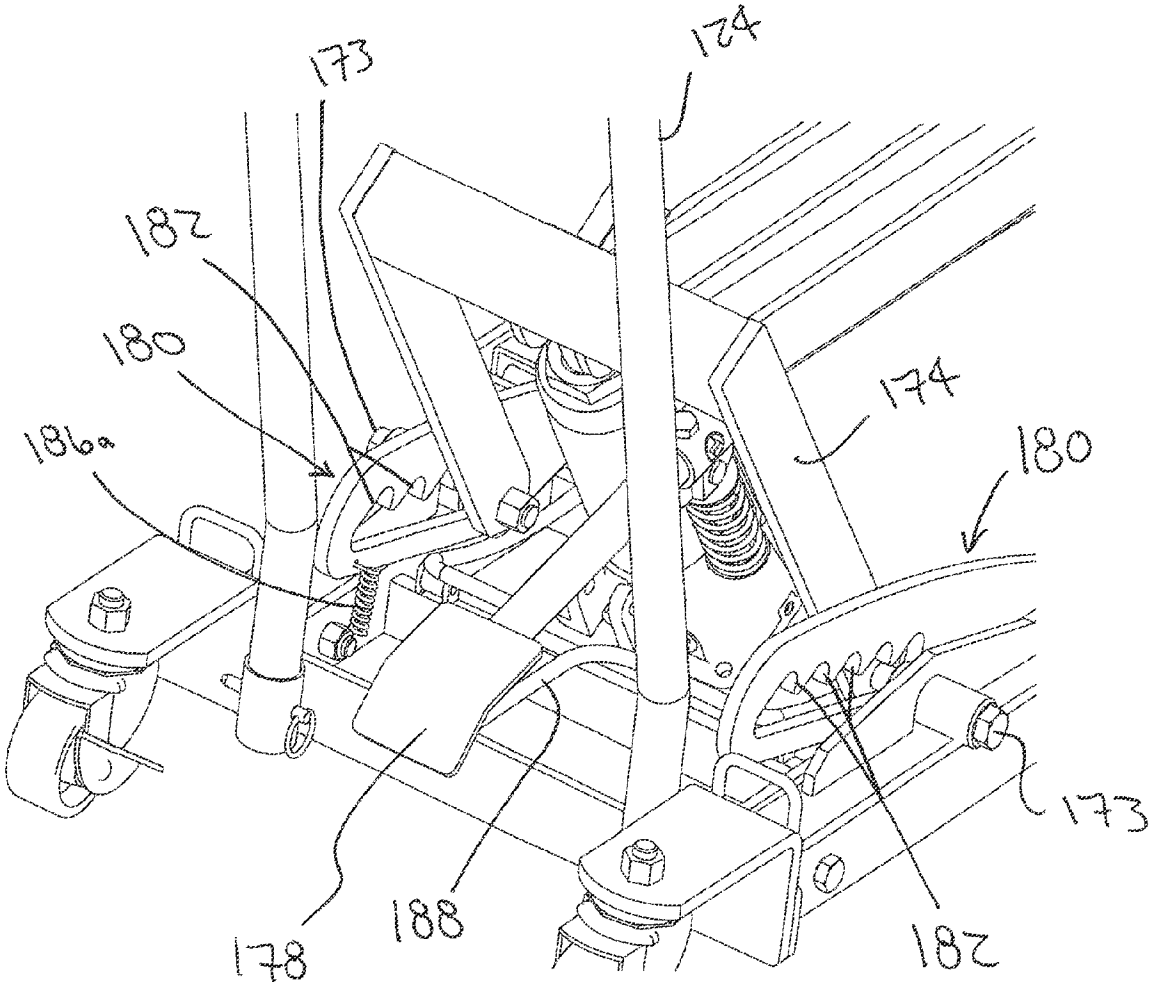
FIG. 13 is another perspective view of a portion of the lifting apparatus of FIG. 1.
Figure 14:
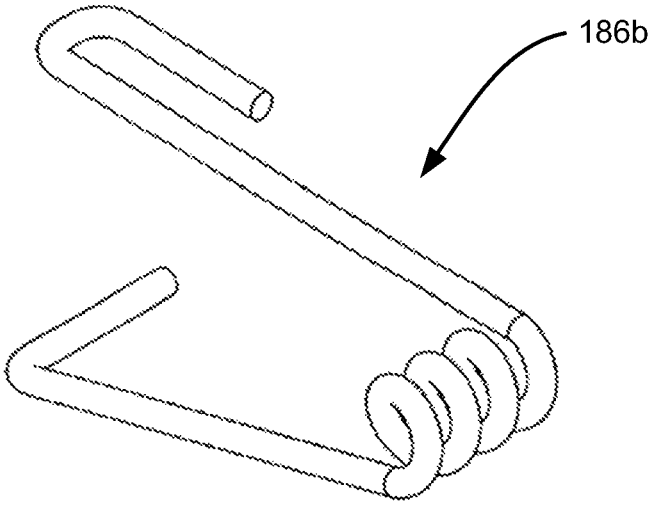
FIG. 14 is another perspective view of a portion of the lifting apparatus of FIG. 1.

Various means may also be included for mechanically maintaining the arms 150 at the raised position 160*b* to prevent the arms 150 from undesirably moving from the raised position 160*b* to the lowered position 160*a*. For example, as shown in FIGS. 12 and 13, a rack 180 may be engageable with at least one of the arms 150 (e.g., through interaction between slots 182 and the pins 173 coupled to respective arms 150) to restrict the arms 150 from leaving the raised position 160*b*. The rack 180 may be automatically biased toward engaging the arm 150 by a resilient member, such as by spring 186*a* (FIG. 13) and/or spring 186*b* (FIGS. 12 and 14). A release 188 (FIGS. 4, 12, 13) is in communication with the rack 180 for selectively disengaging the rack 180 to allow the first and second pairs 154, 155 of arms 150 to move from the raised position 160*b* to the lowered position 160*a*, and may be operable by foot (as shown).

In use, a device (or "load") to be lifted is placed atop the receiving portion 130. For example, tires of a lawn tractor may be received by the tire-receiving members 140. Due to the proximity of the tire-receiving members 140 to the ground (made possible, for example, by the arms 150 being laterally offset and the tire-receiving members 140 extending below the platforms 132, 133 as discussed above), the tires may be easily received in the tire-receiving members 140. If necessary, the tire-receiving members 140 may be telescopically extended to correspond to the spacing between the tires. The configuration and spacing of the platforms 132, 133 may avoid interference with a mower deck of the lawn tractor, and it should be appreciated that other low-clearance devices may accordingly be received as well.

It should also be understood that the receiving portion 130 may be utilized with the tire-receiving members 140 removed, as discussed above and shown in FIGS. 11*a* and 11*b*. More particularly, in applications where lifting by wheels is desirable (e.g., when lifting a lawn tractor), the tire-receiving members 140 may be used as described above, and in applications where lifting in a more traditional manner is desirable (e.g., when lifting a small All Terrain Vehicle (ATV), three-wheeler, or motor scooter), the tire-receiving members 140 may be disconnected and set aside, and the load may be supported by the platforms 132, 133.

To raise the load, the pump 170 may be actuated (such as through the foot pedal 178), causing the piston 172 to extend (FIG. 7). Extension of the piston 172 causes the pins 173 to raise, which in turn causes the arms 150*b*, 150*d* connected to the pins 173 to raise. Raising the arms 150*b*, 150*d* further causes the receiving portion 130 and the remaining arms 150*a*, 150*c* to raise, as those elements are all rotatably coupled together. As the arms 150 raise, the pins 173 automatically interact with subsequent rack slots 182 (e.g., due to the spring 186*a*, the spring 186*b*, and/or the weight of the rack 180) to restrict the arms 150 from lowering, even if the pump 170 fails. Due to the level of safety provided by the arms 150 being mechanically maintained at the raised position 160*b*, people may work underneath the lifted load without fear of the load being unintentionally lowered.

To lower the load, the release 188 (FIGS. 4, 12, 13) is moved (e.g., by foot) to disengage the rack 180 and allow the first and second pairs 154, 155 of arms 150 to move from the raised position 160*b* to the lowered position 160*a*. While the rack 180 is disengaged, the controlled release valve 176 may be used to release pressure, lowering the piston 172 and thus also lowering the arms 150 and the receiving portion 130. The controlled release valve 176 may allow the load to be lowered at various speeds to suit various applications. Once the arms 150 are at the lowered position 160*a*, the load may be easily removed from the receiving portion 130.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed without reference to other features and subcombinations and are contemplated within the scope of the claims. Moreover, various steps set forth herein may be carried out in orders that differ from those set forth herein without departing from the scope of the present methods. The description should not be restricted to the above embodiments, but should be measured by the following claims.

We claim:

1. A lifting apparatus, comprising:

a base having a proximal end and a distal end;

a receiving portion;

a first pair of laterally offset arms rotatably coupled to the base for movement between lowered and raised positions, the first pair of arms being rotatably coupled to the receiving portion, the receiving portion being relatively near the base distal end when the first pair of arms is at the lowered position, the arms of the first pair of arms not sharing a common axis of rotation with one another;

a second pair of laterally offset arms rotatably coupled to the base for movement between lowered and raised positions, the second pair of arms being rotatably coupled to the receiving portion, the receiving portion being relatively near the base distal end when the second pair of arms is at the lowered position, the arms of the second pair of arms not sharing a common axis of rotation with one another;

wherein the base has a first wall extending from the proximal end to the distal end and being generally parallel to the first pair of arms; the first arm of the first pair of arms being on one side of the first wall and the second arm of the first pair of arms being on an opposite side of the first wall, such that from a top view the first wall is intermediate the first and second arms of the first pair of arms; and wherein the base has a second wall extending from the proximal end to the distal end and being generally parallel to the second pair of arms; the first arm of the second pair of arms being on one side of the second wall and the second arm of the second pair of arms being on an opposite side of the second wall, such that from the top view the second wall is intermediate the first and second arms of the second pair of arms.

2. The lifting apparatus of claim 1, wherein:

the receiving portion includes first and second platforms laterally spaced from one another and each having proximal and distal ends; and the platform distal ends are closer to the base distal end than the platform proximal ends are to the base distal end.

3. The lifting apparatus of claim 1, wherein the receiving portion includes means for supporting a lawn tractor.

4. The lifting apparatus of claim 1, further comprising:

means for moving the first and second pairs of arms between the lowered and raised positions; and means for mechanically maintaining the first and second pairs of arms at the raised position to prevent the first and second pairs of arms from undesirably moving from the raised position to the lowered position.

5. The lifting apparatus of claim 1, wherein the arms of the first pair of arms are parallel to one another and to the arms of the second pair of arms.

6. The lifting apparatus of claim 1, wherein the arms of the first pair of arms slant upwardly in the direction of the base distal end when at the lowered position, and wherein the arms of the second pair of arms slant upwardly in the direction of the base distal end when at the lowered position.

7. The lifting apparatus of claim 1, wherein the base includes a plurality of wheels for mobility.

8. A lifting apparatus, comprising:

a base having a proximal end, a distal end, a first side, and a second side;

a receiving portion;

a first arm having proximal and distal ends;

a second arm having proximal and distal ends, the second arm being laterally offset from the first arm, the second arm being parallel to the first arm, the first and second arms being closer to the base first side than to the base second side;

a third arm having proximal and distal ends; and a fourth arm having proximal and distal ends, the fourth arm being laterally offset from the third arm, the fourth arm being parallel to the third arm, the third and fourth arms being closer to the base second side than to the base first side;

wherein the first arm proximal end and the fourth arm proximal end are rotatably coupled to the base to allow the first arm and the fourth arm to move between lowered and raised positions, the first arm proximal end and the fourth arm proximal end rotating about a generally common first axis;

wherein the second arm proximal end and the third arm proximal end are rotatably coupled to the base to allow the second arm and the third arm to move between lowered and raised positions, the second arm proximal end and the third arm proximal end rotating about a generally common second axis;

wherein the first arm distal end, the second arm distal end, the third arm distal end, and the fourth arm distal end are each rotatably coupled to the receiving portion such that the first, second, third, and fourth arms remain parallel to one another; the first arm distal end and the fourth arm distal end rotating about a generally common third axis; the second arm distal end and the third arm distal end rotating about a generally common fourth axis;

wherein the first, second, third and fourth axes are offset from and parallel to each other;

wherein the base has a first wall extending from the base distal end toward the base proximal end, the base first wall being generally parallel to the first and second arms, the first arm being on one side of the first wall and the second arm being on an opposite side of the first wall such that from a top view the first wall is intermediate the first and second arms; and wherein the base has a second wall extending from the base distal end toward the base proximal end, the second wall being generally parallel to the third and fourth arms, the third arm being on one side of the second wall and the fourth arm being on an opposite side of the second wall such that from the top view the second wall is intermediate the third and fourth arms.

9. The lifting apparatus of claim 8, wherein the first axis passes through the first wall and the second wall.

10. The lifting apparatus of claim 9, wherein the second axis passes through the first wall and the second wall.

11. The lifting apparatus of claim 8, wherein the receiving portion includes means for supporting a lawn tractor.

12. The lifting apparatus of claim 8, wherein:

the receiving portion includes first and second platforms laterally spaced from one another and each having proximal and distal ends; and the platform distal ends are closer to the base distal end than the platform proximal ends are to the base distal end.

13. The lifting apparatus of claim 8, further comprising:

means for moving the first, second, third, and fourth arms between the lowered and raised positions; and means for mechanically maintaining the first, second, third, and fourth arms at the raised position to prevent the first, second, third, and fourth arms from undesirably moving from the raised position to the lowered position.

14. The lifting apparatus of claim 8, wherein the first axis and the second axis lie in a common horizontal plane.

* * * * *